United States Patent [19]

Podolsky et al.

[11] 4,088,875

[45] May 9, 1978

[54] OPTIMUM SEQUENTIAL VALVE POSITION INDICATION SYSTEM FOR TURBINE POWER PLANT

[75] Inventors: Leaman B. Podolsky, Wilmington, Del.; Charles L. Groves, Jr., Willingboro Township, Burlington County, N.J.; Steven J. Johnson, Pittsburgh, Pa.

[73] Assignee: Westinghouse Electric Corp., Pittsburgh, Pa.

[21] Appl. No.: 628,629

[22] Filed: Nov. 4, 1975

[51] Int. Cl.[2] ..... F01D 17/00

[52] U.S. Cl. ..... 364/494; 415/13; 60/660; 290/40 R

[58] Field of Search ..... 235/151.21, 151.34; 444/1; 60/39.28 R, 73, 105, 660; 415/1, 13, 15, 17; 290/2, 40, 40.2

[56] References Cited

U.S. PATENT DOCUMENTS

| | | | |
|---|---|---|---|
| 3,552,872 | 1/1971 | Giras et al. | 415/17 |
| 3,555,251 | 1/1971 | Shavit | 235/151 |
| 3,561,216 | 2/1971 | Moore, Jr. | 60/73 |
| 3,564,273 | 2/1971 | Cockrell | 290/40 R |
| 3,588,265 | 6/1971 | Berry | 415/1 |

*Primary Examiner*—Edward J. Wise

*Attorney, Agent, or Firm*—H. W. Patterson

[57] ABSTRACT

A system for indicating optimum positioning of steam inlet valves to minimize steam throttling losses during operation of a turbine power plant in the sequential valve mode is disclosed.

17 Claims, 5 Drawing Figures

OPTIMUM SEQUENTIAL VALVE POSITION INDICATION SYSTEM FOR TURBINE POWER PLANT

CROSS REFERENCE TO RELATED APPLICATION

Ser. No. 408,962, which is a continuation of Ser. No. 247,877, now abandoned, which is a continuation-in-part of Ser. No. 247,440, now abandoned, which is a continuation-in-part of Ser. No. 246,900, now abandoned, and all relating to the general system and method for starting, synchronizing and operating a steam turbine with digital computer control, all filed by Theodore C. Giras and Robert Uram and assigned to the present assignee, said original application being filed on Apr. 24, 1972. The above application describes in detail a Digital Electro-Hydraulic Turbine Control System in which the system of the present application may be utilized, and is incorporated herein by reference to provide a more detailed understanding of such system.

BACKGROUND OF THE INVENTION

In a conventional, large steam turbine power plant, the high pressure turbine is constructed to receive steam through a number of nozzles that are arcuately spaced adjacent the periphery of the first stage of the turbine blading. These nozzles are segregated into groups; and an individual steam inlet or governor valve controls the steam flow through each nozzle group. In starting up the turbine, it is common practice to operate all the governor valves as a single valve to admit the steam through all of the nozzles equally, which is termed, "single valve" or "full arc" mode of operation. The single valve operation permits the heating of the rotor blades evenly to minimize thermal shock. When the turbine is "hot", and all of the governor valves are admitting the required steam in a partially open position, the efficiency of the plant is considerably reduced because of the throttling action or pressure drop across all the partially open valves.

To overcome such inefficiency after start-up, the steam inlet or governor valves are controlled to admit steam through a partial arc of nozzles sequentially; that is, for example, for a low steam flow demand or requirement, the steam is admitted through only a portion of fully open nonthrottled governor valves with only one valve or group of valves being in a throttling position to control any variation in steam flow demand. The remaining valves are closed. As the steam flow demand increases, for example, the valve or valve group in the throttling position opens fully; and then, the next valve or group of valves opens as required to control the steam flow variation in a predetermined sequence. For a decreasing steam flow demand, the valves are controlled in a reverse sequence toward their closed position. Thus, any throttling inefficiency occurs for only one valve or group or valves for certain steam flow requirements.

A conventional steam inlet or governor valve nozzle arrangement has non-linear characteristics after it reaches a certain percentage of total lift; that is, for a valve with a total lift of 7½ inches, for example, approximately 90 to 95 percent of its total maximum steam admission or flow capability occurs in the first two to three inches of valve opening, with the remaining five to ten percent occurring in the remaining 4 to 5 inches of valve travel.

Further, the point at which the valve changes from a linear characteristic to a non-linear characteristic, or in other words, the critical flow point, referred to herein as the FC point of the valve, changes in accordance with the total turbine steam flow, because of the pressure drop across the nozzle group controlled by the valve. For example, if the total steam flow is above, say, 64% of rated flow, the FC point varies from, say, about 3 inches of valve lift down to about 2 inches, as the steam flow increases.

The lift above the FC flow point of the valve, that is, where a slight change in steam flow results in a substantial change in valve lift, referred to as the high slope region, is an undesirable operating region because it causes excessive wear on the valve due to slight variations in steam flow requirements. The linear region of the curve below the FC point of the valve provides stable control, but reduces the efficiency of the plant because of throttling losses. Thus, the optimum position for each of the valves not in a fully open or closed position is the FC point.

In order to overcome the disadvantages of operation in the high slope region, U.S. Pat. No. 3,878,401 dated Apr. 15, 1975, discloses a system, for example, where an increase in steam flow demand which would ordinarily position the steam inlet valve in the non-linear or high slope region, instead, opens the next sequential valve or group of valves, into the linear region. The preceding valve in the sequence is moved toward a closed position and into the linear region to compensate for the flow through the next sequential valve. This overlap system effectively provides stability of operation with minimum valve wear for sequential valve operation.

In order to provide minimum throttling losses and maximum stability for all levels of steam flow when operating in the sequential valve mode, none of the governor valves should be in any position other than fully open, fully closed, or at the end of its linear operating region, referred to as the FC point. For example, at a lower level of load demand, the first valve sequence or group should be either fully open or at the FC point, with the subsequent valves in the sequence fully closed. At a higher level, the first valve operating sequence should be fully open, the next sequence at the FC point, and the remaining sequence fully closed. At still a higher level, first sequential operating groups should be fully open with the last valve or group at the FC point. At any steam flow where one or more valves are partially open below the FC point, the plant is subjected to steam throttling losses; and at flow where one or more of the valves is partially open above the FC point, there may be instablity in response to small steam flow variational requirements and excessive wear.

The digital electrohydraulic turbine power plant control system disclosed in the referenced application to Giras et al. includes indicators on the control panel which inform the operator of the actual position of the governor valves. However, because of the dynamic variation in the location of the FC point at various levels of steam flow and pressure, the operator cannot with certainty determine that the plant is operating with the valves at their optimum position unless, of course, they are all fully open.

In view of the foregoing, it is desirable that a system be provided, such that the operator of a turbine power plant is able to determine when the valves are positioned at their optimum position for all levels of load such that the load, steam pressure, or flow may be varied within operational constraints to operate the plant with a minimum of throttling losses. For use in a system of the type disclosed in the Giras application that does not include the overlap capability of the referenced U.S. patent, the system should also detect when one or more of the valves are in the non-linear or high gain position above the FC point.

SUMMARY OF THE INVENTION

Broadly, the present invention relates to a system for indicating minimum steam throttling losses due to optimum valve positioning during the sequential valve operating mode of a turbine power plant.

Each of the valves, which admit steam to the turbine are controlled by an electrical representation that varies in accordance with the required steam flow. The system generates an electrical representation of a predetermined controlled position, representing the FC point of the valve, and detects the controlled fully open and closed position of each of the valves. The flow demand for each of the valves is compared with the generated FC point representation for each of the valves. An optimum indication is given to the operator at times when all of the valves are either in a fully open position, one of the valves is at the FC point position and the remaining valves are fully closed; or at least one of the valves is fully open, one of the valves is at the FC point and the remaining valves are fully closed; or if desired, all valves except the last valve is fully open and the last valve is between the FC point position and the fully open position.

More specifically, the system of the present invention provides for the predetermined optimum position representation in accordance with a steam flow versus valve lift characterization; and such representation is compared with the representation of steam flow demand for each of the valves in succession. The open position, closed position, and predetermined optimum position include a tolerance or deadband commensurate with system stability.

DESCRIPTION OF THE PREFERRED EMBODIMENTS

Figure 1:
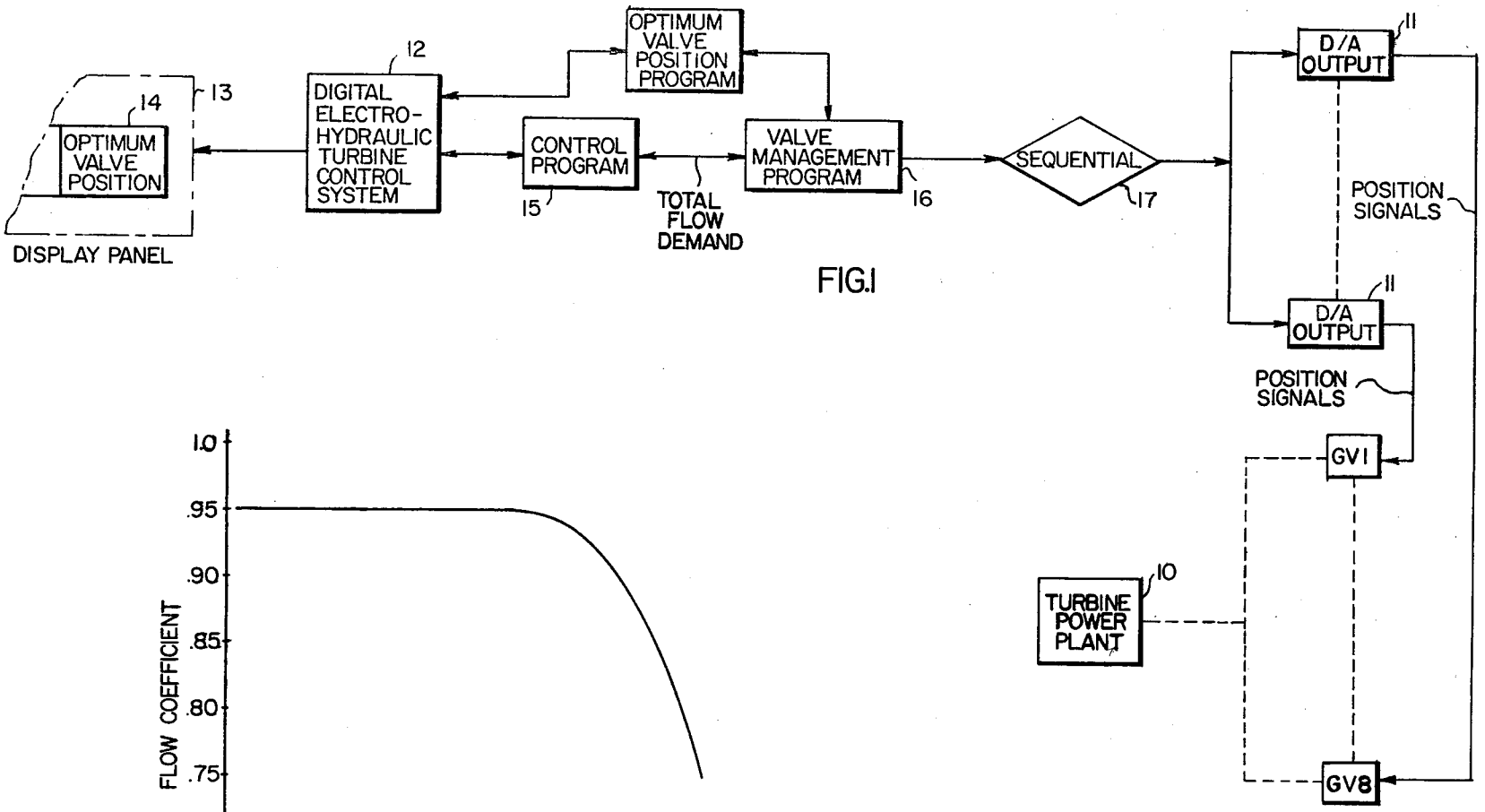
FIG. 1 is a general schematic block diagram of a digital electrohydraulic control system connected to operate the governor valves for controlling a turbine power plant utilizing the system of the present invention according to one embodiment thereof.

Referring to FIG. 1, the conventional turbine power plant referred to at 10 includes a high pressure turbine (not shown), the admission of steam to which is controlled by eight governor valves GV1 through GV8. The governor valves GV1 through GV8 are controlled by an analog signal, which is applied from its associated digital to analog output device referred to at 11. A digital electrohydraulic turbine control system of the feedforward type, which is referred to generally at 12, is described in the referenced application Ser. No. 408,962, to which reference is made for a more detailed understanding thereof.

Briefly, however, the system 12 in its preferred form includes a programmed digital computer with a conventional contact input system and analog input system to interface the system analog and contact signals with the computer at its input. Computer output signals are interfaced with external control devices such as the digital to analog output devices 11, through a conventional contact closure output system. The system also includes a conventional interrupt system to signal the computer when a computer input is to be executed, or when a computer output has been executed. An operator panel such as 13 provides for operator control, monitoring, testing and maintenance functions of the turbine generator system. Signals from the panel 13 are applied to the computer through the contact closure input system; and computer display outputs are applied to the panel 13 through the contact closure and direct digital output systems. The input signals are applied to the computer from various relay contacts in the turbine generator system through the contact closure input system. In addition, the digital electrohydraulic control system receives signals from electric power, steam pressure, and speed detectors, steam valve position detectors and other miscellaneous detectors which are interfaced with the computer. The contact closure outputs from the computer of the system 12 operate various system contacts, a data logger such as an electric typewriter, and various displays, lights and other devices associated with the operator panel 13.

The program system for the computer is preferably organized to operate the control system as a sample data system in providing turbine and plant monitoring and continuous turbine and plant control. The program system also includes a standard executive or monitor program to provide scheduling control over the running of programs in the computer as well as control over the flow of computer inputs and outputs through the previously mentioned input/output systems. Generally, each program is assigned to a task level in a priority system, and bids are processed to run the bidding program with the highest priority. Interrupts may bid programs, and all interrupts are processed with the priority higher than any task level. A more detailed explanation of the program system as well as the digital electrohydraulic turbine control system is disclosed in U.S. Pat. No. 3,878,401, issued Apr. 15, 1975, entitled "System and Method For Operating a Turbine Powered Electrical Generating Plant In A Sequential Mode", which patent is incorporated herein by reference for a more detailed understanding thereof.

This system, as well as the system disclosed in the referenced Giras et al. application Ser. No. 408,962 functions such that, when an operator panel signal is generated, external circuitry decodes the panel input, and an interrupt is generate to cause a panel interrupt program to place a bid for the execution of a panel program which provides a response to the panel request. The panel program can itself carry out the necessary response or it can place a bid for a logic task program to perform the response; or it can bid a visual display program to carry out the response. In turn, any of the above-mentioned programs may operate the contact closure outputs to produce the responsive panel display, such as the display for optimum valve position referred to at 14. Periodic programs are scheduled by an auxiliary synchronizer program which in turn is bid periodically by the executive program. An analog scan program is bid periodically to select analog inputs for updating through an executive analog input handler. After scanning, the analog scan program converts the inputs to engineering units, performs limit checks and makes certain logical decisions.

The system also includes a control program 15 which functions to compute throttle and governor valve positions to satisfy speed and/or load demands during operator or remote automatic operation and tracking valve position during manual operation. Generally, the control program 15 is organized as a series of relatively short subprograms which are sequentially executed.

In performing the turbine-generator control, speed data selection from multiple independent sources is utilized for operating reliability, and operator-entered program limits are placed on high and low load, valve position and throttle pressure. Generally, the control program 15 executes operator or automatically initiated transfers, bumplessly between manual and automatic modes and bumplessly between one automatic mode and another automatic mode. In the execution of control and monitor functions, the control program 15 is supplied, as required, with appropriate representations of data derived from input detectors and system contacts, all as described in the copending referenced Giras application Ser. No. 408,962 and the U.S. Pat. No. 3,878,401. The control program 15 logically determines turbine operating mode by a select operating mode function which operates in response to logic states detected by the previously mentioned logic program from panel and contact closure inputs. In executing turbine control within the control loop described in the application to Giras, the control program includes a speed/load reference function. Once the operating mode is defined, the speed/load reference function generates the reference which is used by the applicable control functions in generating valve position demand.

The speed or load reference is generated at a controlled or selected rate to meet the defined demand. A speed control function in the program 15 provides for operating the throttle and governor valves to drive the turbine to the speed corresponding to the reference with substantially optimum dynamic and steady-state response. Similarly, load control function provides for positioning the governor valves so as to satisfy the existing load reference with substantially optimum dynamic and steady-state response. The load reference value computed by the operating mode selection function, for example, is compensated for frequency participation by a proportional feedback trim factor and for megawatt error by a second feedback trim factor. The frequency and megawatt corrected load reference operates as a setpoint for the impulse pressure control or as a flow demand for a valve management program 16. The output of the impulse pressure controller, or the output of the speed and megawatt corrected load reference, functions as a governor valve setpoint which is converted into a percent flow prior to application to the valve management program 16.

In some installations, where the valve management program 16 is not used, the governor valve control function of the control program 15 may employ a nonlinear characterization function to compensate for the nonlinear flow versus lift characteristics of the governor valve. In such case, the output from the nonlinear characterization function represents governor valve position demand which is based on the input flow demand. However, with the utilization of the valve management system as described in the U.S. Pat. No. 3,878,401, which is incorporated by reference herein, the governor valve control function provides for holding the governor valves closed during a turbine trip, holding the governor valves wide open during start-up and under throttle valve control, driving the governor valves closed during transfer from throttle to governor valve operation during start-up, reopening the governor valves under position control after brief closure during throttle/governor valve transfer and thereafter during subsequent load control.

During automatic computer control, the valve management program 16 develops the governor valve position demands needed to satisfy steam flow demand and ultimately the speed/load reference; and to do so in either the sequential or the single valve mode of governor valve operation or during transfer between these modes. Since changes in throttle pressure can cause actual steam flow changes in any given turbine inlet valve position, the governor valve position demands may be corrected as a function of throttle pressure variation. Governor valve position is calculated from a linearizing characterization in the form of a curve of valve position (or lift) versus steam flow. A curve valid for low load operation is stored for use by the valve management program 16, and the curve employed for control calculations is attained by correcting the stored curve for changes in load or flow demand, and preferably for changes in actual throttle pressure. Another stored curve of flow coefficient versus steam flow demand is used to determine the applicable flow coefficient to be used in correcting the stored low-load position demand curve for load or flow changes. Preferably, the valve position demand curve is also corrected for the number of nozzles downstream from each governor valve. A more detailed explanation of such valve position versus steam flow, and flow coefficient curve is provided in connection with the description of FIGS. 2 and 3.

In the sequential valve mode, which is represented by block 17 of FIG. 1, the governor valve sequence is used, in determining from the corrected position demand curve, which governor valve or group or governor valves is fully open, and which governor valve or group of governor valves is to be placed under position control to meet load reference changes. Position demands are determined for the individual governor valves; and individual sequential valve analog voltages (11) are generated to correspond to the calculated valve position demands.

Figure 2:
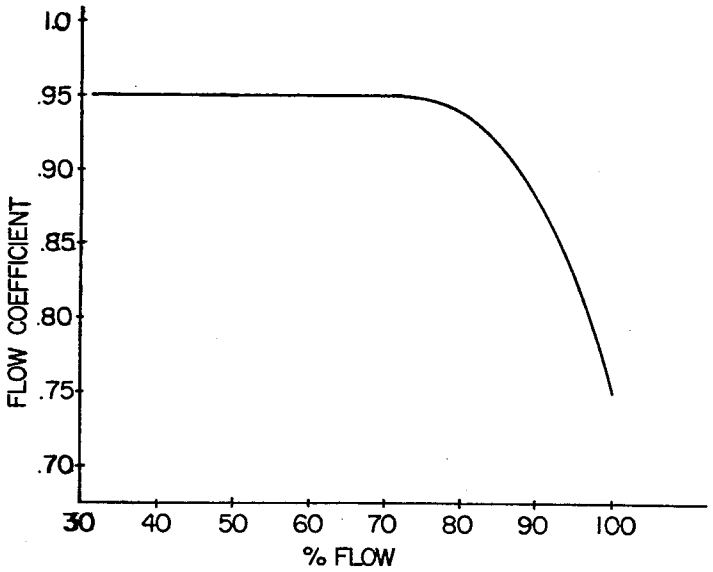
FIG. 2 is a graph illustrating valve lift as a function of steam flow for various total steam flow requirements.

Referring to FIG. 2, data representing flow coefficients is contained in the computer memory of the control system 12 based on the flow demand computed by the digital electrohydraulic control system. The flow value is shown on the abscissa of the curve and the flow coefficient is calculated along the ordinate. The flow coefficient is the ratio of actual flow at a flow demand over the theoretical flow if the orifice coefficient were equal to one. Once the ordinate for a particular flow demand is calculated by use of the data in the computer memory, the stage flow coefficient is calculated, which is used to calculate the curve of FIG. 3.

Figure 3:
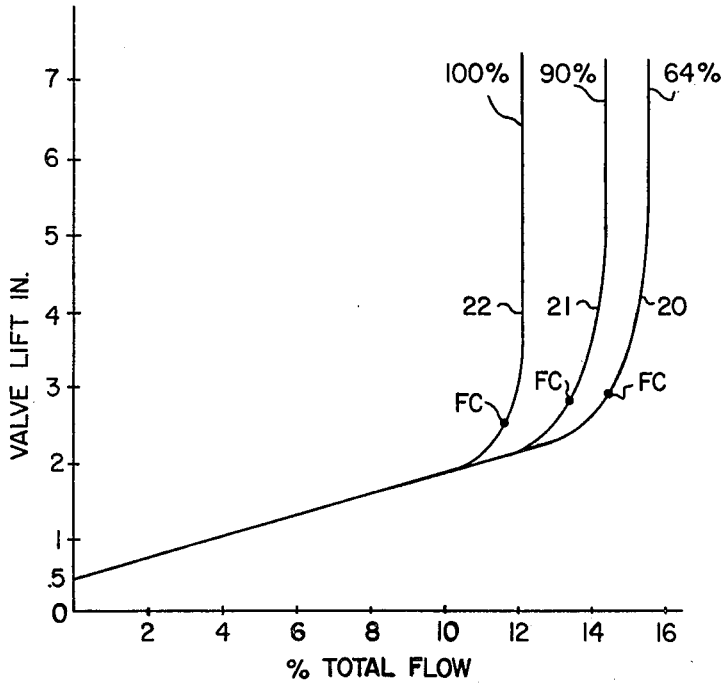
FIG. 3 is a graph illustrating the flow coefficient for various percentages of steam flow utilized in characterizing steam flow versus valve lift.

In FIG. 3, the flow demand for each valve is represented as a percentage of total flow on the abscissa; and the lift of the steam inlet or governor valve is shown on the ordinate, whereby the lift of the valve for a predetermined flow demand can be calculated. A curve 20 represents a dynamic characterization of operation of a control or governor valve from its closed position to its fully open position to pass its proportionate shore at approximately 64% of total steam flow. The corrected stage flow coefficient for critical flow (see FIG. 2) is essentially equal to one for the typical installation described where flow demands are less than 64% of total flow. The exact transition point may vary between 60 and 70%, for example, from installation to installation depending upon the design of the governor valve. If the total flow demand is greater than that having a corrected flow coefficient of one, a different curve, such as that referred to at 21 for a total steam flow of 90%; and another curve referred to at 22 for a 100% total steam flow demand is calculated. Each curve, such as 20, 21, or 22, is composed preferably of five linear segments in order to facilitate ease of calculation and economy of memory space in the computer. The curves are calculated by multiplying the abscissa and the ordinate of each of the curves by the stage flow coefficient of FIG. 2. The curves such as 20, 21, and 22 may be either calculated by the computer in accordance with the total steam flow demand or there may be a plurality of such curves stored in the computer with the appropriate curve being selected for particular steam flows. The curves of 20, 21, and 22 may also be modified dynamically for variations in the throttle pressure and also for variation in the number of nozzles under each valve, as described in the referenced U.S. Pat. No. 3,878,401. For each of the curves an FC flow point is calculated, above which a very high associated gain is required in order to maintain and linearize any action of the actuator for the control valve. Between such FC point and the fully opened position only approximately five to ten percent of the flow for that valve is controlled. Between such FC point and the fully closed position, the efficiency of the plant is reduced because of steam losses due to throttling. In calculating the FC point, the maximum steam flow that the valve is capable of admitting is calculated in accordance with the total steam flow demand. A predetermined percentage of such maximum flow, such as 92%, for example, is the FC point.

Figure 4:
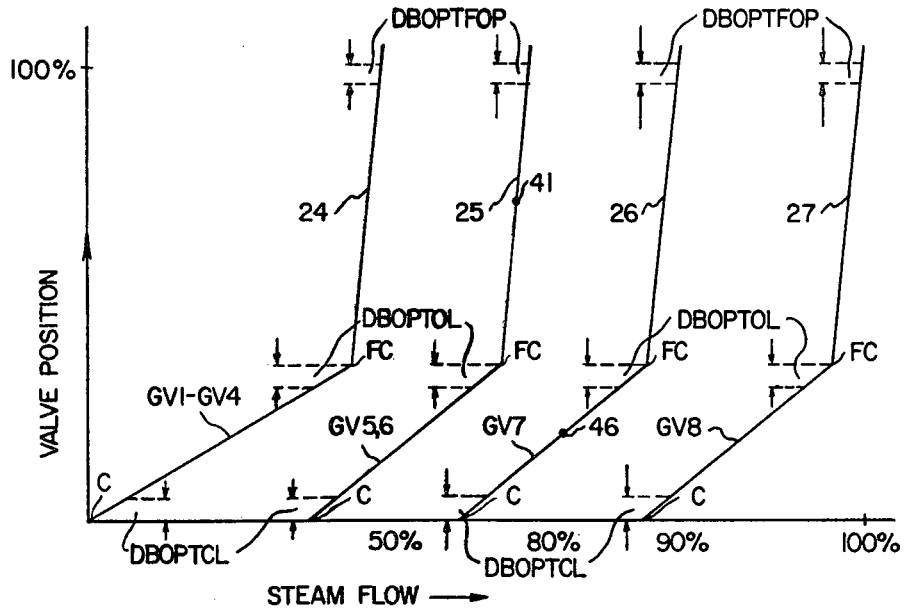
FIG. 4 is a graphical illustration of a typical grouping of eight governor valves for sequential mode operation showing the critical flow point, open position, and closed position including a deadband.

Referring to FIG. 4, for more detail in connection with the optimum valve position according to the present embodiment, the ordinate represents valve position between fully closed and fully open, and the abscissa a steam flow from 0 to 100%. In a typical governor valve sequential control mode, for example, the governor valves GV5 through GV8 may be initially closed as the governor valves GV1 through GV4 are jointly operated from time to time to positions producing the desired total steam flow. Line 24 represents the valve position of the governor valves GV1 through GV4 from 0% steam flow to approximately 60-65% total steam flow in the fully open position. Line 25 represents the governor valves GV5 and GV6, which are assumed to operate as a group, in the same manner as the valves GV1 through GV4. Line 26 represents the operation of the valve GV7, and line 27 represents the operation of the governor valve GV8. After the governor valves GV1 through GV4 (line 24) have reached the end of their control region; i.e., upon being fully open, or at some point prior to reaching the fully open position, the governor valves GV5 and GV6, as represented by line 25, begin to open. Then the governor valves GV7 and GV8 as represented by lines 26 and 27 are placed in operation in numerical order to produce continued steam flow control at higher steam flow levels. This governor valve sequence of operation, of course, is based on the fact that the governor valve controlled nozzles are arcuately spaced about the 360° periphery of the turbine high pressure casing. The flow point FC on each of the curves 24 through 27 represents the flow for each of the valves at the beginning of the high slope region between the point FC and the fully open position O of the valve curve. The portion of the line between FC and C is that portion of the valve travel which causes steam throttling losses. In accordance with the present embodiment, the portion of the valve travel between the dashed lines referred to as DBOPTCL represents the deadband range for the optimum position of the valve when closed; that is, if the valve should be within such dashed lines then the valve is considered in an optimum position. That portion of the valve travel between the dashed lines DBOPTOL represents the deadband for the optimum position when the valve is at the end of its linear range. Similarly, the portion of the valve travel between the dashed lines DBOPTOP is the deadband which provides an optimum fully open position for the valve. These deadbands are provided in the system in order that the optimum indication will have some stability, and a small change in steam flow demand does not result in the indicator 14 turning on and off. Thus, if any of the valves are positioned at any point except in the fully open position, the end of the linear range, or the closed position providing other valves are open, then the valves are not in an optimum position, and if desired, for the last valve in the sequence located between FC and wide open.

Figure 5:
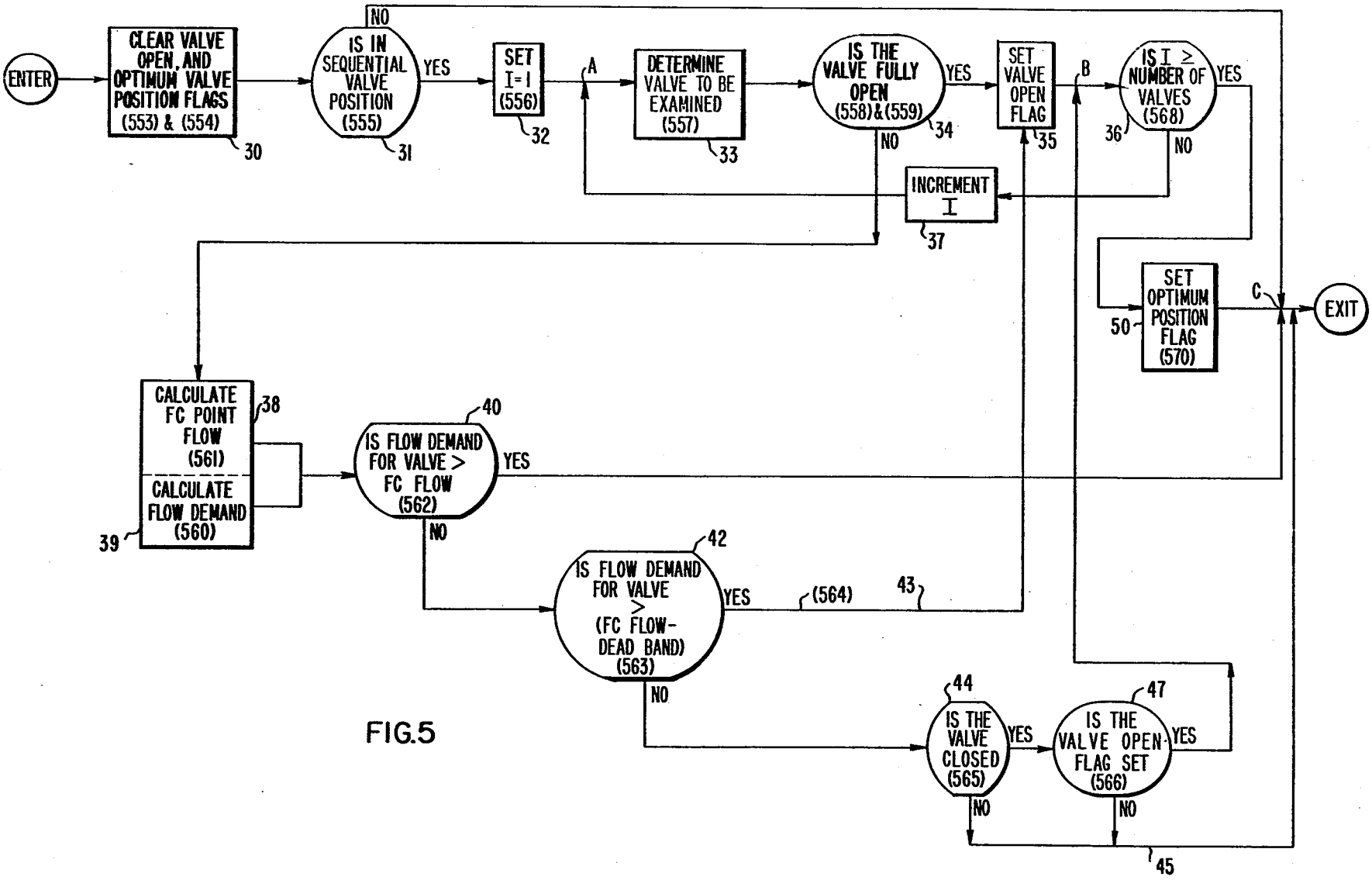
FIG. 5 is a flow chart of the system according to one embodiment of the invention.

Referring to FIG. 5, which illustrates the flow chart for the system of the present invention, includes, in addition to the reference characters, numerical designations in each of the blocks. These numerical designations correspond to the statement numbers in the Fortran listing of the Appendix. The optimum valve detection program is run periodically; and first clears the flags which indicate a "valve open" and an "optimum valve position" as shown by block 30. The "valve open" flag functions to detect the open or optimum position of each of the individual valves, and the "optimum valve position" flag functions to detect that none of the valves are in the partially open position below the FC point. After the flags have been cleared at 30, the program checks at 31 to determine if the turbine is operating in the sequential valve mode. If it is not, the program merely exits as shown by line 32, because in the single valve mode of operation, the optimum valve position is not required in accordance with the present embodiment of the invention. It is contemplated, however, that such system could be used in the single valve mode, if desired. After determining that the system is in sequential valve operation, the program sets the do loop counter to 1 at block 32. Then a determination is made at 33 as to which valve of the sequence is first to be examined. Assuming that the sequence of valve operation is the same as shown in the graph of FIG. 4, the first valve to be interrogated is GV1. Then a determination is made at 34 as to the fully opened position of the valve GV1. The fully opened position is checked by checking the value of the variable IGVAO which is the demanded position of the valve from the valve management program described in the referenced U.S. Pat. No. 3,878,401. Assuming that the valve GV1 is controlled to be fully open, the "valve open" flag is set at 35. The program then checks if the particular valve being interrogated is the last valve in the sequence at 36. If it is not, the valve number is incremented at 37 and the valve GV2 is examined at 33. Because the valves GV1 through GV4 operate as a group in the present example, the do loop would go through blocks 33 through 36 four times with similar results. The fifth time, the valve GV5 is examined; and assuming that the valve GV5 is not fully opened, the FC point flow is calculated at 38 and the flow demand for the valve GV5 is calculated at 39. The flow demand for the valve GV5 is compared with the FC flow at block 40. If such flow demamd is greater, which would indicate that the position of the valve as represented by the line 25 of FIG. 4 would have to be at point 41, for example, between the FC point and the fully opened position. In such event, the program exits without indicating that the valves are in an optimum position and without the necessity of interrogating any of the remaining valves in the sequence.

However, assuming that the flow demand is not greater than the FC flow, a block 42 determines whether the flow demand for the valve GV5 is greater than the FC flow minus the deadband; that is, does the flow demand fall within the valve lift position on the line 25 referred to as DBOPTOL. If it does fall in the deadband optimum position, the valve open flag 35 is set via line 43. The do loop is then repeated for the valve GV6 through the blocks 36 and 37. In the present example, the valves GV5 and GV6 operate as a group; therefore, the program follows the same path for the valve GV6 as it did for GV5. Assuming that the block 34 determines that the valve GV7 is not fully opened; and that the flow demand for the valve GV7 is not greater than the FC flow; and also that the flow demand for valve GV7 is not within the band DBOPTOL on line 26, the valve is checked at 44 to determine if it is closed. If the valve GV7 is not closed, the program merely exits over line 45 indicating that the position of the valve is between C and FC such as at point 46, for example of FIG. 4, which provides loss of efficiency due to valve throttling. However, if the valve is closed, the program then checks at 47 to determine if the "valve open" flag had been set during the interrogation of any of the previous valves in the sequence. If none of the previous valves had been determined to be fully open, or at their FC point; and the present valve being interrogated is fully closed, then the program exits. However, assuming that the valve GV7 is closed, and that the "valve open" flag has been set by a previously interrogated governor valve, then the block 36 checks to determine if it is the last valve in the sequence. If not, the valve GV8 is then interrogated. Assume that the valve GV8 is not fully opened; (34) and that the calculated FC point flow (38) is less than the calculated flow demand for GV8 (39) as determined by the block 40, then the program exits. However, assuming the calculated flow demand for the valve GV8 is not greater than FC as determined at 40 and further is not greater than the FC point flow minus the deadband as determined at 42; and the valve GV8 is determined to be closed at 44; then, the "valve open" flag is checked at 47. The block 36 then determines that the governor valve GV8 is the last valve of the sequence. Upon such determination, the optimum position flag is set at 50 and the program exits. In response to the setting of the optimum position flag, the indicator 14 on the panel 13 is illuminated informing the operator that the valves are in an optimum position.

Appendix A discloses a Fortran listing of program computer steps which form part of a complete program system for the computer of the digital electrohydraulic control system 12 of FIG. 1. This listing represents the program steps most directly related to the embodiment of a system for indicating minimum throttling losses due to optimum valve position arranged in accordance with the principles of the invention. Generally, the listing embodies program functions like those described herein in connection with the description of the flow chart of FIG. 5.

In summary, a system for indicating optimum valve position during the sequential valve operating mode of the turbine power plant operates by checking each of the steam inlet or governor valves in the sequence in which such valves are controlled to admit varying levels of steam flow to the turbine. In determining the fully open and fully closed positions for each of the valves, the system utilizes the position demand (IGVAO) plus a small tolerance or deadband. In determining the position of the valve intermediate the fully open or fully closed position, the system utilizes the flow demand for each valve FLOSEQ which is calculated in accordance with a valve lift versus steam flow curve. This is compared with a calculated electrical representation of an FC point for each valve, which point represents a percentage of maximum flow adjacent the end of the linear range of the valve prior to the valve going into the so-called high slope region of relatively unstable control. The FC point is calculated in accordance with the previously described percentage FC1 of the maximum possible flow FVMX. The maximum possible flow for each such valve is determined in accordance with the steam flow versus valve lift curve. The FC point also has a tolerance or deadband.

Each time the system operates, it first effectively eliminates all flags which would indicate that the valves were in an optimum position. Then the system checks the operating mode to determine that the system is operating in the sequential valve mode. It then checks for each valve, as to whether or not the valve is within the fully opened deadband range DBOPTFOP; and if such is the case, the "valve open" flag is set and the program goes to the next valve in the sequence. If it is not fully opened, the system then checks to determine if the steam flow demand for the valve is greater than the calculated FC point. If such is the case, the program exits and starts from the beginning to check the complete sequence of valves. If the flow demand is not greater than the FC point, the system then checks to determine if the valve is within the FC point deadband range DBOPTOL. If such is the case, the "valve open" flag is set and the system goes on to check the next valve. If the valve is not in such range, the system then checks to determine whether or not the valve is in a fully closed position within the deadband range DBOPTCL. If such is the case, the program then checks to determine if the "valve open" flag has been set by a previous valve; then the system continues with checking the next valve in the sequence. However, if the valve is neither in the closed position or the "valve open" flag has not been set, then the program exits. Thus, each time a valve is determined not to be in one of the optimum positions, the program starts over again and eliminates all indications that any of the valves were in such optimum position.

```
C
C
C     OPTIMUM VALVE POSITION CHECK
C
C
C
1500  LOPTVLV = .FALSE.
      LVLVOPN = .FALSE.
      IF( .NOT. OA . .OR. SING .OR. SINGTR .OR. SEQTR )GO TO 1530
      DO 1520 I = 1, NOVLV
      J = ICOMLS(I)
      TEMP1 = IGVAO(J+1)
      IF( RGF:( TEMP1,DBOPTFOP ) )GO TO 1510
      TEMP2 = FLOSEQ(J)
      TEMP3 = FC1 * FVMX(J)
      IF( RGT;(TEMP2,TEMP3) )GO TO 1530
      TEMP3 = TEMP3 - DBOPTTOL
      IF( RGT:(TEMP2,TEMP3) )GO TO 1510
      IF( RGT:(TEMP1,DBOPTCL) )GO TO 1530
      IF ( .NOT. LVLVOPN )GO TO 1530
      GO TO 1520
1510  LVLVOPN = .TRUE.
1520  CONTINUE
      LOPTVLV = .TRUE.
1530  CONTINUE
```

What we claim is:

1. A system for indicating minimum steam throttling losses due to optimum valve positioning during the operation of a turbine power plant, comprising a plurality of steam inlet valve means for controlling the flow of steam to the turbine, means to generate an electrical representation of valve lift position required for each valve means, means to generate an electrical representation of a predetermined valve lift position, said predetermined position being at a substantially minimum throttling lift position intermediate a substantially fully open and fully closed lift position, means to compare the generated required valve lift position representation with the generated predetermined valve lift position for each of the valve means, detection means effective when actuated to indicate the optimum position of the plurality of valve means, and means governed by the comparison means and the generated electrical representation of required valve lift position to activate the detection means at times when the valve means are controlled to the substantially closed position, substantially open position, or the predetermined intermediate position only.

2. A system according to claim 1 wherein the means to generate the required valve lift representation includes means to generate a representation of total steam flow demand to the turbine, and means to calculate said valve lift representation in accordance with a valve lift versus steam flow characterization in accordance with the total steam flow demand representation.

3. A system according to claim 2 wherein the means to generate the predetermined intermediate lift position representation includes means to generate a maximum flow representation in accordance with the total steam flow representation, and means to multiply said maximum flow representation by a predetermined percentage.

4. A system according to claim 1 wherein the predetermined intermediate position representation includes a range adjacent the upper end of the linear portion of the valve lit.

5. A system according to claim 1 wherein the means to activate the detection means includes, first means to determine the substantially fully open position of the valve means, second means responsive to a negative determination by the first means to determine that the required valve lift representation is greater than the predetermined intermediate representation by the comparison means, third means responsive to a negative determination by the first means to determine that the required valve lift position representation is within a predetermined deadband less than the predetermined intermediate lift representation, fourth means responsive to a negative determination by the third means to determine that the valve means is in a substantially closed position, and fifth means responsive to a positive determination by the fourth means to activate the detection means.

6. A system according to claim 1 wherein the representation of predetermined intermediate valve lift corrsponds to a predetermined steam flow for the valve means.

7. A system for indicating minimum steam throttling losses due to optimum valve positioning during the sequential operation of a turbine power plant; comprising (a) a plurality of steam inlet valve means, each of which includes at least one valve, for controlling the flow of steam to the turbine;

(b) means to generate an electrical representation of total steam flow demand for the turbine;

(c) means to generate an electrical representation of a controlled lift position for each of the valve means for sequential operation in accordance with the total steam flow demand representation;

(d) means to generate an electrical representation of a predetermined controlled lift intermediate the fully open and closed position corresponding to a minimum steam throttling position for each of the valve means;

(e) an optimum valve position detection means governed by the generated electrical representations of controlled lift and predetermined intermediate lift positions to detect the controlled position of each valve means in the substantially fully open position or in the predetermined intermediate lift position;

(f) means to detect the controlled substantially closed position of each valve means other than that detected by the optimum valve position detection means; and (g) means governed by the closed detection means and the optimum valve position detection means operative when activated to indicate the optimum valve position of the valve means.

8. A system according to claim 7 wherein the generated representation of controlled lift corresponds to the steam flow demand for each valve means, and the generated representation of the controlled intermediate lift corresponds to a predetermined percentage of the steam flow representation for each valve means.

9. A system according to claim 8 wherein the steam flow demand representation on the predetermined intermediate steam flow is calculated in accordance with a steam flow versus valve lift characterization governed by the generated representation of total steam flow demand.

10. A system according to claim 7 wherein the means for generating the representation of a predetermined intermediate lift position includes means to generate a representation corresponding to a maximum flow capability for each of the valve means in accordance with the total flow demand representation, and means to generate an electrical representation corresponding to a predetermined percentage of the representation of maximum flow.

11. A system according to claim 7 wherein the controlled position of each of the valve means is detected by said optimum and closed detection means in succession.

12. A system according to claim 11 wherein each of the valve means constitutes one steam inlet valve only.

13. A system according to claim 11 wherein the indicating means is activated only in response to the detection of all the valve means by the optimum valve position detection means and the closed detection means.

14. A system according to claim 13 wherein the indicating means is activated in response to the operation of both the optimum valve position detection means and the closed position detection means or only the optimum valve position detection means for all the valves

15. A system for indicating minimum steam throttling losses due to optimum valve positioning during the sequential operation of a turbine power plant; comprising (a) a plurality of steam inlet valve means, each of which includes at least one valve, for controlling the flow of steam to the turbine;

(b) calculating means including sequencing means having the following components, means to generate an electrical representation of total steam flow demand, means to generate an electrical representation of steam flow demand for each of the valve means for sequential mode operation, means to generate an electrical representation of steam flow for a predetermined position intermediate the open and closed positions, means governed by the valve steam flow demand representation to detect the substantially open position of each valve means, means governed by the representation of predetermined steam flow to detect a predetermined valve position, said position corresponding to a position at the end of the linear valve lift range, means governed by the valve steam flow demand representation to detect the substantially closed position of each valve means, an optimum valve detection means activated in response to the detection of at least one of the vlave means by either the open or predetermined detection means to be either in the open or predetermined controlled position and in response to the detection of only remaining valve means by the closed detection means to be in the substantially closed position, and indicating means responsive to the activation of the optimum valve detection means to inform the operator that all the valve means are in the optimum position.

16. A system according to claim 15 wherein the means to generate the representation of steam flow for the predetermined position is governed by a representation of maximum flow capability, and includes means governed by the total steam flow to generate the representation of maximum flow capability.

17. A system according to claim 15 wherein the calculating means is structured in a programmed digital computer.

* * * * *